US006330894B1

(12) United States Patent
Austin

(10) Patent No.: US 6,330,894 B1
(45) Date of Patent: Dec. 18, 2001

(54) WOOD BENDING JIG

(76) Inventor: Donald G. Austin, P.O. Box 701, 780 Forest Glen Trail, Florissant, CO (US) 80816

( * ) Notice: Subject to any disclaimer, the term of this patent is extended or adjusted under 35 U.S.C. 154(b) by 59 days.

(21) Appl. No.: 09/662,011

(22) Filed: Sep. 14, 2000

(51) Int. Cl.[7] ..... B25H 1/01

(52) U.S. Cl. ..... 144/269; 144/256.1; 144/259

(58) Field of Search ..... 144/2.1, 256.1, 144/259, 260, 261, 267, 268, 269, 270; 269/58; 156/443, 583.8

(56) References Cited

U.S. PATENT DOCUMENTS 927,975 * 7/1909 Kaufman et al. ..... 144/256.1
4,688,612 * 8/1987 Kessel et al. ..... 144/259
5,199,475 * 4/1993 Koeder ..... 144/269
5,203,948 * 4/1993 Suska ..... 144/269

* cited by examiner

*Primary Examiner*—W. Donald Bray

(57) ABSTRACT

A jig having particularly advantageous application in the construction of custom spiral staircases. The jig for bending a wooden board comprises: a trunk; and, multiple arms each arm having an inner end portion releasably attached to the trunk and an outer arm portion adapted to removably attach the wooden board thereto. When the wooden board is attached to the outer end portions of the arms the wooden board will have bent to conform to a curve defined by the end portions of the arms as it extends up, and around the trunk. Most preferably the trunk and arms comprise cylindrical tubes. The arm portions which attach to the trunk comprise split cylinders which may be lockably squeezed over the trunk with a bolt. Each arm comprises an inner cylindrical tube which closely and lockingly slides within an outer cylindrical tube so that the outer end portion of the arm may be locked at a selected radius from the trunk so that the jig may be used to bend boards at varying radiuses.

14 Claims, 1 Drawing Sheet

WOOD BENDING JIG

FIELD OF THE INVENTION

This invention relates to the construction of curved wooden structures with bent wooden boards. More particularly this invention relates to a wood bending jig which can be adapted to bend boards on any selected radius and which can accommodate even complex curves. The jig has particularly advantageous application in the construction of custom spiral staircases.

BACKGROUND OF THE INVENTION

Arches and curves provide a beauty and eye appeal in architectural structures which is not provided by square lines. However, despite their inherent beauty, the labor intensive and time consuming task of constructing rounded structures severely limits their use. When a round staircase is built a large cylindrical wall form which will circumscribe the staircase is first fabricated. The stringers are then wrapped around this form, and the stair boards are fitted into the form with angles bolted to the wall form. Finally the wall form is removed from the stinger and stair boards; and the stair boards are fastened directly to the stringer. Considerable time and materials are utilized fabricating the cylindrical wall form and considerable time is consumed disassembling, then reassembling the stringers and stair boards after the cylindrical wall form has been removed. There is a need for a simpler, faster and less expensive method of constructing a rounded stair case.

OBJECTS OF THE INVENTION

It is an object of this invention to disclose a wood bending jig which facilitates the construction of rounded stair cases. A wood bending jig which can be used to fabricate both inner and outer stair stringers, stair railings, stair skirts, rounded beams for round openings through floors, as well as eliptical beams for openings through pitched roofs. It is an object of this invention to disclose a wood bending jig which eliminates the step of constructing a cylindrical form to build the rounded stair cases in and around. It is an object of this invention to disclose a wood bending jig which will allow stringers to be bent with and stair boards to be attached to the bent stringers directly and without the necessity of disassembling and then reassembling the stair case. It is yet a further object of this invention to disclose a wood bending jig which is adjustable to accommodate varying radiuses and pitches of inclination of varying stair cases. It is a final object of this invention to disclose a wood bending jig which can accommodate even complex curves, curves which have varying radiuses along their periphery.

One aspect of this invention provides for a jig for bending a wooden board, above a supporting surface comprising: a trunk; and, multiple arms each arm having an inner end portion releasably attached to the trunk and an outer arm portion adapted to removably attach the wooden board thereto. When the wooden board is attached to the outer end portions of the arms the wooden board will have bent to conform to a curve defined by the end portions of the arms as it extends up, and around the trunk.

In a preferred aspect the invention in the above jig, the trunk and radial arms comprise cylindrical tubes. The arm portions which attach to the trunk comprise split cylinders which may be lockably squeezed over the trunk with a bolt. Each arm comprises a second inner cylindrical tube which closely and lockingly slides within a first outer cylindrical tube so that the outer end portion of the arm may be locked at a selected radius from the trunk so that the jig may be used to bend boards at varying radiuses.

Various other objects, advantages and features of this invention will become apparent to those skilled in the art from the following description in conjunction with the accompanying drawings.

FIGURES OF THE INVENTION

Figure 1:
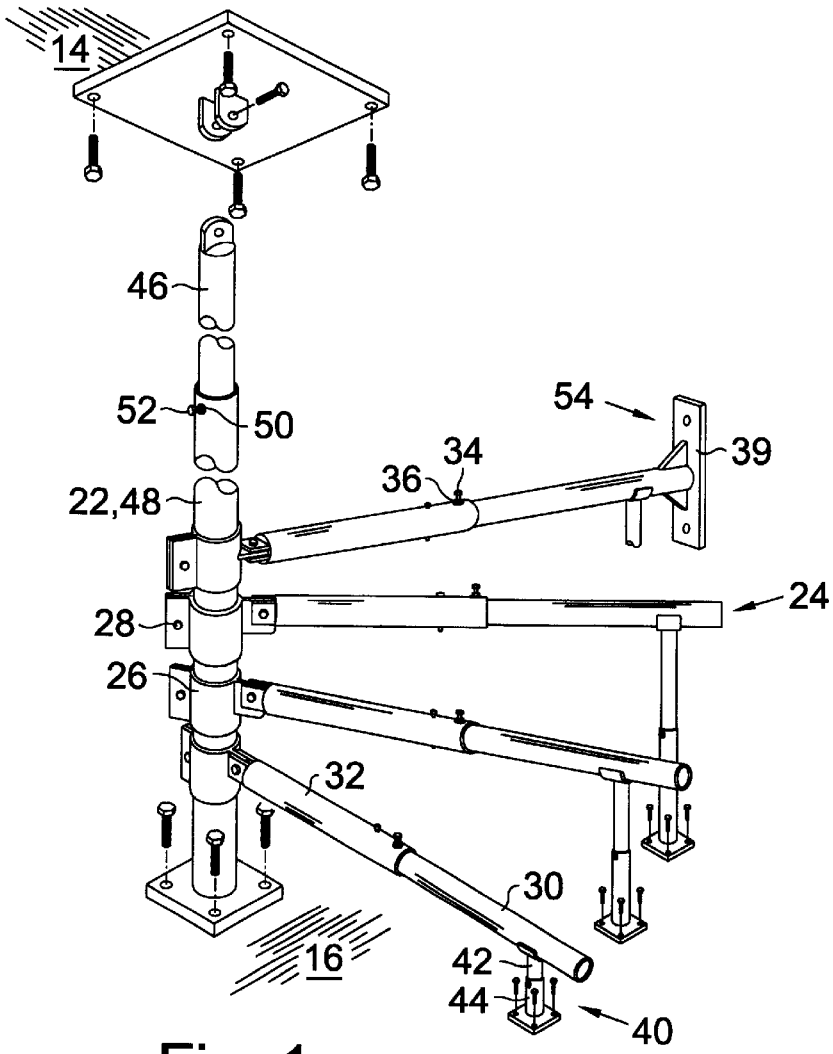
FIG. 1 is a partial perspective view of a wood bending jig.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a partial perspective view of a wood bending jig 20. The jig 20 for bending a wooden board 18, above a supporting surface 16 comprises: a trunk 22; and, multiple arms 24 each arm 24 having an inner end portion releasably attached to the trunk 22 and an outer arm portion adapted to removably attach the wooden board 16 thereto. When the wooden board 18 is attached to the outer end portions of the arms 24 the wooden board 18 will have bent to conform to a curve defined by the end portions of the radial arms 24 as it extends up, and around the trunk 22.

Most preferably a bottom end portion of the trunk 22 is adapted to attach to the supporting surface 16 and a top portion of the trunk 22 is adapted to attach to a supporting member 14 so that the trunk 22 may be rigidly held in an upright position. Most preferably the trunk 22 and arms 24 comprise cylindrical tubes. In the most preferred embodiment of the invention the arm 24 portion which attaches to the trunk 22 comprises a split cylinder 26 which may be lockably squeezed over the trunk 22 with a bolt 28. The arms 24 may either swing vertically or horizontally where bolted to the trunk 22. In the most preferred embodiment of the invention the radial arms 24 each comprise a second inner cylindrical tube 30 which closely and lockingly slides within a first outer cylindrical tube 32 so that the outer end portion of the arm 24 may be locked at a selected radius from the trunk 22. A set bolt 34 is tightened into a hex nut 36 welded onto the outer cylindrical tube to lock the length of the arm 24. This allows the same jig 20 to bend boards 18 at varying radiuses.

FIG. 1 also shows the jig 20 having arm end support posts 40. The posts 40 have a bottom end portion adapted to attach to the supporting surface 16 and having an upper end portion adapted to support the outer end portion of the arm 24. The end support posts comprise a smaller cylindrical tube 42 which closely and lockingly slides within a larger cylindrical tube 44 so that the post's supporting height may be selectively varied to support the end portion of the arms 24 at varying heights along the trunk 22. In the most preferred embodiment of the invention the trunk 22 comprises an upper inner pole 46 and a lower outer pole 48, said poles

46,48 are slidingly and lockingly engaged so that the trunk 22 may be slidingly elongated and locked at a selected height. The poles 46,48 may be locked together with a nut 50 welded to the outer pole 48 which engages a set bolt 52.

Figure 2:
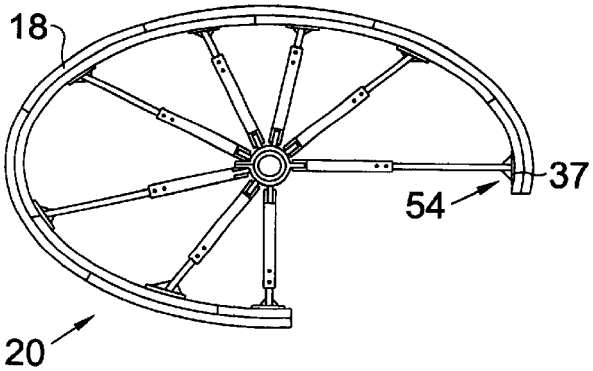
FIG. 2 is a plan view of a wood bending jig bending laminated boards in a complex spiral.

FIG. 2 is a plan view of a wood bending jig 20 bending laminated boards 18 in a complex spiral. FIG. 2 shows one embodiment of the invention wherein the outer end portions of the arms 24 further comprise a board attachment bracket 54. The board attachment bracket 54 may comprise either a relatively short horizontal member 37 or a longer vertical member 39. Alternatively, as shown in FIG. 1 the outer end portions of the arms 24 may comprise only a straight length of tube so that the board 18 may be attached thereto with the clamp portions of a standard bar clamp 46 (the clamp portions are slid over the straight length of tube comprising the outer end portion of the arm 24 to replace the bar in the clamp 46).

Figure 3:
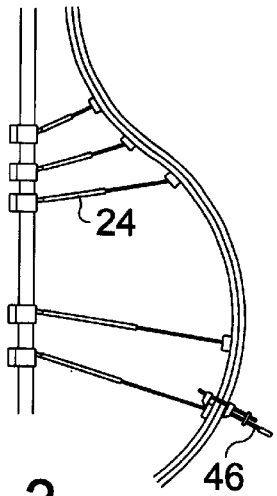
FIG. 3 is an elevational view of the wood bending jig being used to bend a rafter in an onion shape such as used in an Arabic dormer.

FIG. 3 is an elevational view of the wood bending jig 20 being used to bend boards 18 to form an onion shaped rafter such as used in an Arabic dormer (not shown). In this figure the boards are secured to the end portions of the arms 24 with bar clamps 46. All of the arms 24 extend radially in a common plane.

For illustration, and without intending to limit the generality of the foregoing it has been found that the inner pole should be 3⅜" OD and 9 feet long, and if the outer pole is 4" OD diameter and 12 feet long and 4" OD. Board attachment brackets 36 are 14" long, 2" wide, and ¼" thick. The laminated wooden boards 18 may be either 1'×3" or 1"×4".

While the invention has been described with preferred specific embodiments thereof, it will be understood that this description is intended to illustrate and not to limit the scope of the invention, which is defined by the following claims.

I claim:

1. A jig for bending a wooden board, above a supporting surface comprising:

a trunk; and, multiple outwardly extending arms each arm having an inner end portion releasably attached to the trunk and an outer arm portion adapted to removably attach the wooden board thereto;

so when the wooden board is attached to the outer end portions of the arms the wooden board will have bent to conform to a curve defined by the end portions of the arms as it extends up, and around the trunk.

2. A jig as in claim 1 wherein a bottom end portion of the trunk is adapted to attach to the supporting surface and a top portion of the trunk is adapted to attach to a supporting member so that the trunk may be rigidly held in an upright position.

3. A jig as in claim 2 wherein the arms extend outwardly radially and wherein the trunk and arms comprise cylindrical tubes.

4. A jig as in claim 3 wherein the arm portion which attaches to the trunk comprises a split cylinder which may be lockably squeezed over the trunk with a bolt.

5. A jig as in claim 4 wherein the arms rotate vertically where bolted to the split cylinder.

6. A jig as in claim 4 wherein the arms rotate horizontally where bolted to the split cylinder.

7. A jig as in claim 4 wherein the arms each comprise a second inner cylindrical tube which closely and lockingly slides within a first outer cylindrical tube so that the outer end portion of the arm may be locked at a selected radius from the trunk so that the jig may be used to bend boards at varying radiuses.

8. A jig as in claim 5 wherein the outer end portions of the arms further comprise a board attachment bracket.

9. A jig as in claim 5 wherein the outer end portions of the arms comprise only a straight length of tube so that the board may be attached thereto with a standard bar clamp adapted to slide thereover.

10. A jig as in claim 5 further comprising arm end support posts, said posts having a bottom end portion adapted to attach to the supporting surface and having an upper end portion adapted to support the outer end portion of the radial arm.

11. A jig as in claim 8 wherein the end support posts comprise cylindrical tubes.

12. A jig as in claim 9 wherein the end support posts comprise a smaller cylindrical tube which closely and lockingly slides within a larger cylindrical tube so that the post's supporting height may be selectively varied to support the end portion of the arms at varying heights along the trunk.

13. A jig as in claim 3 wherein the trunk comprises an upper inner pole and a lower outer pole, said poles slidingly and lockingly engaged so that the trunk may be slidingly elongated and locked at a selected height.

14. A jig as in claim 11 wherein the poles may be locked together with a nut welded to the outer pole which engages a set bolt.

* * * * *